US008821194B2

(12) United States Patent
Shih et al.

(10) Patent No.: US 8,821,194 B2
(45) Date of Patent: Sep. 2, 2014

(54) CONNECTOR ASSEMBLY

(71) Applicant: Hon Hai Precision Industry Co., Ltd., New Taipei (TW)

(72) Inventors: Chi-Tse Shih, New Taipei (TW); Chin-Feng Chen, New Taipei (TW); Tay-Yang Lin, New Taipei (TW)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 0 days.

(21) Appl. No.: 13/726,397

(22) Filed: Dec. 24, 2012

(65) Prior Publication Data

US 2013/0267126 A1 Oct. 10, 2013

(30) Foreign Application Priority Data

Apr. 6, 2012 (TW) ..... 101112137 A

(51) Int. Cl.
*H01R 24/00* (2011.01)
*H01R 13/518* (2006.01)

(52) U.S. Cl.
CPC ..... *H01R 13/518* (2013.01); *H01R 23/02* (2013.01)
USPC ..... 439/668

(58) Field of Classification Search
CPC .. H01R 13/518; H01R 24/58; H01R 2103/00; H01R 23/02
USPC ..... 439/540.1, 660, 668
See application file for complete search history.

(56) References Cited

U.S. PATENT DOCUMENTS

| | | | |
|---|---|---|---|
| 2,749,526 | A | 6/1956 | Petersen |
| 4,421,371 | A | 12/1983 | Clark et al. |
| 4,640,570 | A | 2/1987 | Strate |
| 5,409,403 | A | 4/1995 | Falossi et al. |
| 6,250,967 | B1 | 6/2001 | Chu |
| 2008/0242148 | A1 | 10/2008 | Omura et al. |

*Primary Examiner* — Khiem Nguyen
(74) *Attorney, Agent, or Firm* — Novak Druce Connolly Bove + Quigg LLP

(57) ABSTRACT

A connector assembly includes a connector plug and a connector socket. The connector plug includes an outer surface which includes a first portion and a second portion. The first portion includes a plurality of first plug signal transmitting pins. The second portion includes a plurality of second plug signal transmitting pins. The connector socket includes an inner surface. The inner surface is divided into a first area and a second area by a first insulating portion. The first area includes a plurality of first socket signal transmitting pins. The second area includes a plurality of second socket signal transmitting pins. The connector plug inserts in the connector socket to connect the plurality of first plug signal transmitting pins to the plurality of first socket signal transmitting pins, and simultaneously connect the plurality of second plug signal transmitting pins to the plurality of second socket signal transmitting pins.

12 Claims, 2 Drawing Sheets

CONNECTOR ASSEMBLY

CROSS-REFERENCE TO RELATED APPLICATIONS

This application is related to another application, entitled "CONNECTOR ASSEMBLY" U.S. Ser. No. 13/726,406, filed simultaneously with this application, and having the same assignee as this application. The entire contents of the copending application are incorporated herein by reference.

BACKGROUND

1. Technical Field

The present disclosure relates to connector assemblies that can transmit a plurality of signals.

2. Description of Related Art

Connectors are widely used in electronic devices to transmit signals. For transmitting different signals, the electronic device often uses different connectors, and each connector transmits one kind of signal. Therefore, a plurality of different types of connector must be mounted on the electronic device, which has a high cost and consumes a lot of space in the electronic device.

Therefore, there is room for improvement within the art.

BRIEF DESCRIPTION OF THE DRAWINGS

Many aspects of the embodiments can be better understood with reference to the following drawings. The components in the drawings are not necessarily drawn to scale, the emphasis instead being placed upon clearly illustrating the principles of the embodiments. Moreover, in the drawings, like reference numerals designate corresponding parts throughout the several views.

DETAILED DESCRIPTION

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references mean "at least one."

Figure 1:
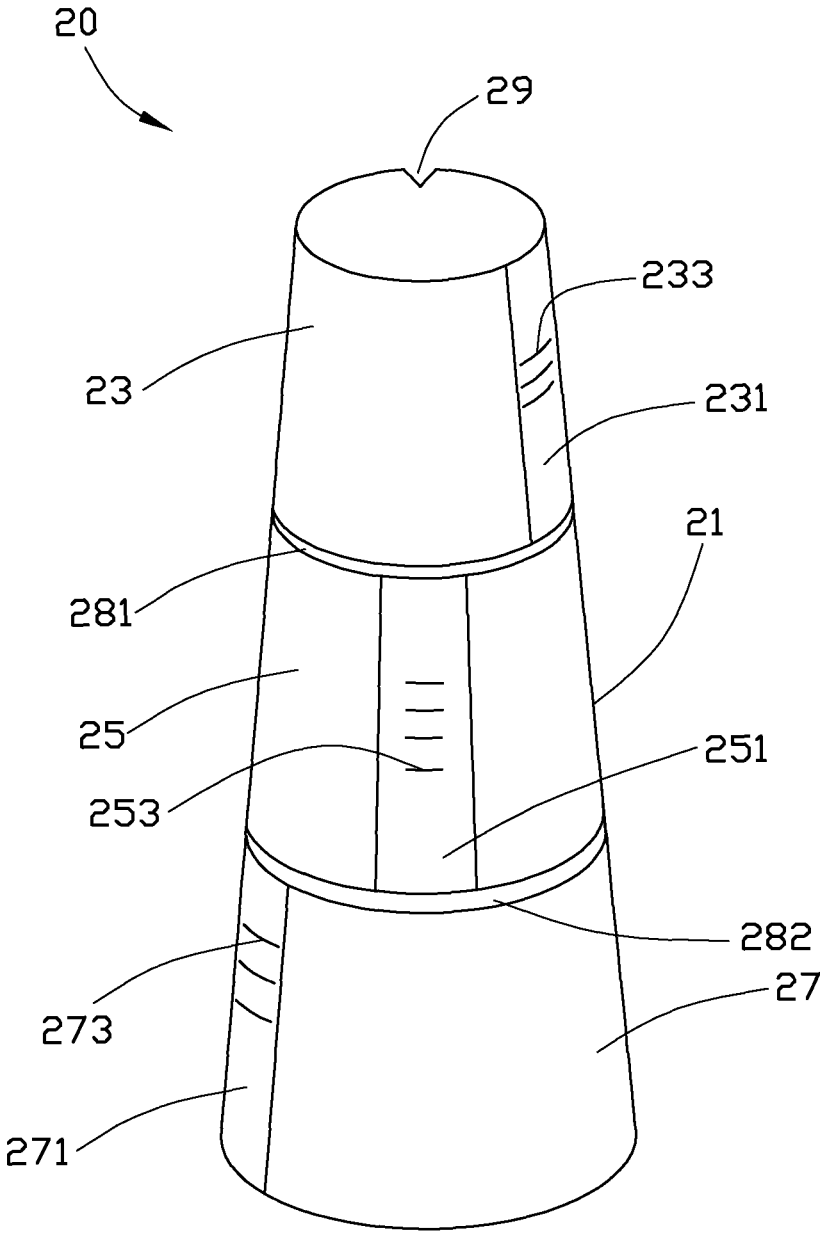
FIG. 1 is a sketch view of a connector plug of a connector assembly in accordance with an embodiment.
Figure 2:
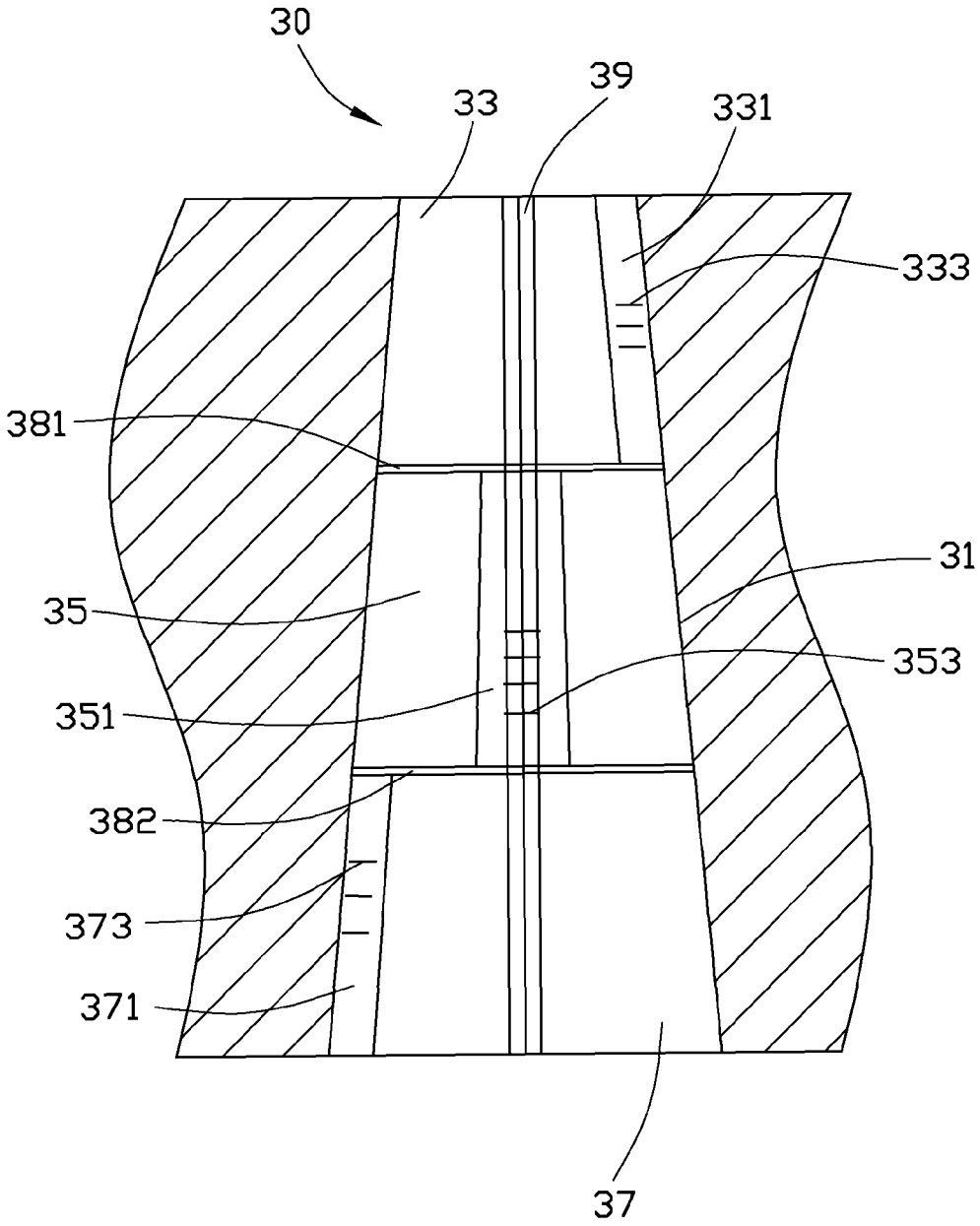
FIG. 2 is a sectional view of a connector socket of the connector assembly of FIG. 1.

Referring to FIGS. 1 and 2, a connector assembly in accordance with an embodiment includes a connector plug 20 and a connector socket 30.

Referring to FIG. 1, the connector plug 20 is the shape of a truncated cone which includes an outer surface 21. The outer surface 21 is divided into a plurality of portions in an axial direction. In one embodiment, the plurality of portions includes a first portion 23, a second portion 25, and a third portion 27. The first portion 23 is located on a topmost portion of the connector plug 20, and the third portion 27 is located on a bottommost portion of the connector plug 20. The second portion 25 is located between the first portion 23 and the third portion 27. A first insulating strip 281 is located between the first portion 23 and the second portion 25 to separate the first portion 23 from the second portion 25. A second insulating strip 282 is located between the second portion 25 and the third portion 27 to separate the second portion 25 from the third portion 27.

Two grooves are radially defined on a right part of the first portion 23 to form a first plug signal transmitting surface 231. A plurality of parallel first plug signal transmitting pins 233 are laid on the first plug signal transmitting surface 231. The plurality of first plug signal transmitting pins 233 transmit a first signal, such as a USB signal.

Two grooves are defined on a middle part of the second portion 25 to form a second plug signal transmitting surface 251 on the second portion 25. A plurality of parallel second plug signal transmitting pins 253 are laid on the second plug signal transmitting surface 251. The plurality of second plug signal transmitting pins 253 transmit a second signal, such as an AGP signal.

Two grooves are defined on a left part of the third portion 27 to form a third plug signal transmitting surface 271 on the third portion 27. A plurality of parallel third plug signal transmitting pins 273 are laid on the third plug signal transmitting surface 271. The plurality of third plug signal transmitting pins 273 transmit a third signal, such as an audio signal.

The first plug signal transmitting surface 231, the second plug signal transmitting surface 251, and the third plug signal transmitting surface 271 are misaligned with each other, in that a peripheral angular displacement of approximately 60 degrees exists between each of the surfaces 231, 251, and 271, and the respective average diameter of those surfaces also increases in the stated order.

A cutout 29 is defined on the outer surface 21. The cutout 29 does not meet or interfere with any of the surfaces 231, 251, or 271.

Referring to FIG. 2, the connector socket 30 receives the connector plug 20. The connector socket 30 is substantially hollow, of a shape which matches that of the connector plug 20, and includes an inner surface 31. The inner surface 31 is divided into a plurality of portions. In one embodiment, the plurality of portions includes a first area 33, a second area 35, and a third area 37. The first area 33 is located on a topmost portion of the connector socket 30 (that is to say, the portion of a truncated cone with the smallest diameter), and the third area 37 is located on a bottommost portion of the connector socket 30 (that is to say, the portion of a truncated cone with the largest diameter). The second area 35 is located between the first area 33 and the third area 37. A first insulating portion 381 is located between the first area 33 and the second area 35 to separate the first area 33 from the second area 35. A second insulating portion 382 is located between the second area 35 and the third area 37 to separate the second area 35 from the third area 37.

Two grooves are defined on a right part of the first area 33 to form a first socket signal transmitting surface 331. A plurality of parallel first socket signal transmitting pins 333 are laid on the first socket signal transmitting surface 331. The plurality of first socket signal transmitting pins 333 transmit the first signal.

Two grooves are defined on a middle part of the second area 35 to form a second socket signal transmitting surface 351. A plurality of parallel second socket signal transmitting pins 353 are laid on the second socket signal transmitting surface 351. The plurality of second socket signal transmitting pins 353 transmit the second signal.

Two grooves are defined on a left part of the third area 37 to form a third socket signal transmitting surface 371. A plurality of parallel third socket signal transmitting pins 373 are laid on the second socket signal transmitting surface 371. The plurality of third socket signal transmitting pins 373 transmit the third signal.

The first socket signal transmitting surface 331, the second socket signal transmitting surface 351, and the third socket signal transmitting surface 371 are misaligned with each other, in substantially the same fashion as the angular displacements and different average diameters of the three portions of the connector plug 20.

A ridge 39 protrudes inwards from the inner surface 31 and corresponds to the cutout 29 of the outer surface 21.

All of the signal transmitting pins 233, 253, 273, 333, 353, and 373 are curved.

To join the connector plug 20 and the connector socket 30, the ridge 39 is aligned to the cutout 29. The connector plug 20 is inserted in the connector socket 30. The ridge 39 slides in the cutout 29. The first plug signal transmitting pins 233 are coupled to the first socket signal transmitting pins 333. The second plug signal transmitting pins 253 are coupled to the second socket signal transmitting pins 353. The third plug signal transmitting pins 273 are coupled to the third socket signal transmitting pins 373. The first insulating strip 281 contacts the first insulating portion 381. The second insulating strip 282 contacts the second insulating portion 382. The connector plug 20 and the connector socket 30 can thus exchange three different kinds of signal simultaneously, and with each type of signal independent of the others.

In another embodiment, the connector plug 20 and the connector socket 30 can provide connections to enable the exchange of two, four, five or more different kinds of signals.

It is to be understood, however, that even though numerous characteristics and advantages of the embodiments have been set forth in the foregoing description, together with details of the structure and functions of the embodiments, the disclosure is illustrative only, and changes may be made in detail, especially in the matters of shape, size, and arrangement of parts within the principles of the present disclosure to the full extent indicated by the broad general meaning of the terms in which the appended claims are expressed.

What is claimed is:

1. A connector assembly, comprising:

a connector plug comprising an outer surface, the outer surface comprising a first portion and a second portion, the first portion and the second portion are separated by a first insulating strip, a plurality of first plug signal transmitting pins laid on the first portion, and a plurality of second plug signal transmitting pins laid on the second portion; and a connector socket comprising an inner surface, the inner surface is divided into a first area and a second area, the first area and the second area separated by a first insulating portion, a plurality of first socket signal transmitting pins laid on the first area, and a plurality of second socket signal transmitting pins laid on the second area;

wherein the connector plug is configured to insert in the connector socket to connect the plurality of first plug signal transmitting pins to the plurality of first socket signal transmitting pins to transmit a first signal, and simultaneously connect the plurality of second plug signal transmitting pins to the plurality of second socket signal transmitting pins to transmit a second signal;

the connector plug is the shape of a truncated cone, the first portion is located above the second portion, and the first area is located above the second area; two first grooves are defined in the first portion to form a first plug signal transmitting surface on the first portion, two second grooves are defined in the second portion to form a second plug signal transmitting surface on the second portion, the first plug signal transmitting surface is misaligned with the second plug signal transmitting surface in an axial direction of the connector plug, the plurality of first plug signal transmitting pins are laid on the first plug signal transmitting surface, and the plurality of second plug signal transmitting pins are laid on the second plug signal transmitting surface; and two third grooves are defined in the first area to form a first socket signal transmitting surface in the first area, two fourth grooves are defined on the second area to form a second socket signal transmitting surface on the second portion, the first socket signal transmitting surface is misaligned with the second socket signal transmitting surface in the axial direction of the connector plug, the plurality of first socket signal transmitting pins are laid on the first plug signal transmitting surface, and the plurality of second socket signal transmitting pins are laid on the second plug signal transmitting surface.

2. The connector assembly of claim 1, wherein the first plug signal transmitting surface is located on a non-middle part of the first portion, and the second plug signal transmitting surface is located on a middle part of the second portion.

3. The connector assembly of claim 1, wherein the first socket signal transmitting surface is located on a non-middle part of the first area, and the second plug signal transmitting surface is located on a middle part of the second area.

4. The connector assembly of claim 1, wherein the outer surface defines a cutout, the inner surface comprises a ridge, and the ridge is configured to slide in the cutout when the connector plug is inserted in the connector socket.

5. The connector assembly of claim 1, wherein each of the plurality of first plug signal transmitting pins, the plurality of second plug signal transmitting pins, the plurality of first socket signal transmitting pins, and the plurality of second socket signal transmitting pins is curved.

6. A connector assembly, comprising:

a connector plug comprising an outer surface, a first insulating strip divides the outer surface into a first portion and a second portion, two first grooves are defined in the first portion to form a first plug signal transmitting surface, and two second grooves are defined on the second portion to form the second plug signal transmitting surface which is misaligned with the first plug signal transmitting surface;

a connector socket comprising an inner surface, a first insulating portion divides the inner surface into a first area and a second area, the first area comprising a first socket signal transmitting surface, and the second area comprising a second socket signal transmitting surface which is misaligned with the first socket signal transmitting surface;

wherein the connector plug is configured to insert in the connector socket to contact the first plug signal transmitting surface to the first socket signal transmitting surface to transmit a first signal, and simultaneously contact the second plug signal transmitting surface to the second socket signal transmitting surface to transmit a second signal.

7. The connector assembly of claim 6, wherein the connector plug is a truncated cone, the first portion is located above the second portion, and the first area is located above the second area.

8. The connector assembly of claim 7, wherein a plurality of first plug signal transmitting pins are laid on the first plug signal transmitting surface, and a plurality of second plug signal transmitting pins are laid on the second plug signal transmitting surface.

9. The connector assembly of claim 8, wherein two third grooves are defined in the first area to form the first socket signal transmitting surface on the first area, two fourth grooves are defined on the second area to form the second socket signal transmitting surface on the second portion, a plurality of first socket signal transmitting pins are laid in the first plug signal transmitting surface, and a plurality of second socket signal transmitting pins are laid on the second plug signal transmitting surface.

10. The connector assembly of claim 8, wherein each of the plurality of first plug signal transmitting pins, the plurality of second plug signal transmitting pins, the plurality of first socket signal transmitting pins, and the plurality of second socket signal transmitting pins is curved.

11. The connector assembly of claim 6, wherein the first plug signal transmitting surface is located on a non-middle part of the first portion, the second plug signal transmitting surface is located on a middle part of the second portion; the first socket signal transmitting surface is located on a non-middle part of the first area, and the second plug signal transmitting surface is located on a middle part of the second area.

12. The connector assembly of claim 6, wherein the outer surface defines a cutout, the inner surface comprises a ridge, and the ridge is configured to slide in the cutout when the connector plug is inserted in the connector socket.

* * * * *